US008206162B1

(12) United States Patent
Hsieh et al.

(10) Patent No.: US 8,206,162 B1
(45) Date of Patent: Jun. 26, 2012

(54) CONNECTOR MODULE AND RETRACTABLE CONNECTOR DEVICE

(75) Inventors: Chun-Yu Hsieh, Taipei County (TW); Wen-Jeng Fang, Taipei (TW); Chih-Heng Chiu, Taipei (TW); Chung-Won Shu, Taipei (TW)

(73) Assignee: Transcend Information, Inc., NeiHu Dist., Taipei (TW)

( * ) Notice: Subject to any disclaimer, the term of this patent is extended or adjusted under 35 U.S.C. 154(b) by 0 days.

(21) Appl. No.: 13/018,446

(22) Filed: Feb. 1, 2011

(51) Int. Cl.
*H01R 13/44* (2006.01)

(52) U.S. Cl. ..... 439/131

(58) Field of Classification Search ..... 439/131, 439/78–80, 493, 752, 260, 83, 876; 361/752, 361/737
See application file for complete search history.

(56) References Cited

U.S. PATENT DOCUMENTS 5,127,839 A * 7/1992 Korsunsky et al. ..... 439/79
5,320,541 A * 6/1994 Korsunsky et al. ..... 439/79
5,644,839 A * 7/1997 Stone ..... 29/842
6,231,363 B1 * 5/2001 Kosmala ..... 439/260
6,238,237 B1 * 5/2001 Nagahata et al. ..... 439/493
7,872,873 B2 * 1/2011 Hiew et al. ..... 361/737
7,931,480 B2 * 4/2011 Zhu ..... 439/78
8,025,511 B2 * 9/2011 Aihara et al. ..... 439/141
2004/0145875 A1 * 7/2004 Yu et al. ..... 361/752
2008/0218799 A1 9/2008 Hiew

FOREIGN PATENT DOCUMENTS

TW M373038 1/2010
TW M374169 2/2010
TW M387417 8/2010
TW M389958 10/2010

* cited by examiner

*Primary Examiner* — Jean F Duverne
(74) *Attorney, Agent, or Firm* — Winston Hsu; Scott Margo

(57) ABSTRACT

A connector module is disclosed in the present invention. The connector module includes a housing, a substrate whereon a first set and a second set of metal contacts are formed, and at least one conductive resilient piece piercing through the housing. The substrate is disposed inside the housing with the first set of metal contacts exposed outwardly. A first end of the conductive resilient piece is fixed on an outer surface of the housing, and the conductive resilient piece is resiliently deformed and electrically contacts the second set of metal contacts when the conductive resilient piece is pressed by a conductive component of an connector receptacle.

16 Claims, 5 Drawing Sheets

CONNECTOR MODULE AND RETRACTABLE CONNECTOR DEVICE

BACKGROUND OF THE INVENTION

1. Field of the Invention

The present invention is related to a connector module and a related connector device, and more particularly, to a USB connector module and a retractable USB connector device.

2. Description of the Prior Art

With the advanced technology, a USB 3.0 connector is designed for increasing speed of data transmission that is obviously faster than a USB 2.0 connector. One type of conventional USB 3.0 connector includes a substrate, a first set of metal contacts, a second set of metal contacts and a plurality of resilient metal pieces. The first set of metal contacts conforms to USB 2.0 standard and is disposed on a front end of the substrate. The first set of metal contacts and the second set of metal contacts collectively conform to USB 3.0 standard, and the second set of metal contacts and the corresponding resilient metal pieces are disposed on the substrate behind the first set of metal contacts. The plurality of resilient metal pieces is disposed on the substrate for electrical contact. A fixing end of each resilient metal piece is fixed on and electrically contacts the second set of metal contacts, and a free end of each resilient metal piece is suspended for being touched by contacts of a connector receptacle.

Thus, the plurality of resilient metal pieces is damaged easily due to collision of an external object as being exposed outside when the conventional USB 3.0 connector is not inserted into the connector receptacle In addition, the plurality of resilient metal pieces electrically contacts the second set of metal contacts continuously, so that any electrical device with the conventional USB 3.0 connector will be potentially damaged due to electrical conduction with other charged components through the exposed resilient metal pieces and a first set of metal contacts. Therefore, a design of a memory connector with preferable protection, such as preventing the substrate from damage of electrical conduction and protecting the resilient metal pieces from being damaged by collision of the external object, is an important issue in the memory connector industry.

SUMMARY OF THE INVENTION

The present invention provides a USB connector module and a retractable USB connector device for solving above drawbacks.

According to one aspect of the invention, a connector module includes a housing, a substrate whereon a first set and a second set of metal contacts are formed, and at least one conductive resilient piece piercing through the housing. The substrate is disposed inside the housing with the first set of metal contacts exposed outwardly. A first end of the conductive resilient piece is fixed on an outer surface of the housing. The conductive resilient piece is resiliently deformed and electrically contacts the second set of metal contacts when the connector module is inserted into a connector receptacle and the conductive resilient piece is pressed by a conductive component of the connector receptacle, and the conductive resilient piece is not resiliently deformed and does not electrically contact the second set of metal contacts when the connector module is not inserted into the connector receptacle, so as to prevent the conductive resilient piece from resilient fatigue or physical collision and to prevent the substrate from damage by the electrical conduction with the other charged component through the conductive resilient piece.

According to another aspect of the invention, a retractable connector device includes a covering, and a connector module slidably disposed inside the covering. The connector module includes a housing, a substrate whereon a first set and a second set of metal contacts are formed, and at least one conductive resilient piece piercing through the housing. The substrate is disposed inside the housing with the first set of metal contacts exposed outwardly. A first end of the conductive resilient piece is disposed on the housing, and the conductive resilient piece is resiliently deformed and electrically contacts the second set of metal contacts when the connector module is inserted into a connector receptacle and the conductive resilient piece is pressed by a conductive component of the connector receptacle.

According to another aspect of the invention, a first opening is formed on the covering of the retractable connector device, and the first end of the conductive resilient piece protrudes from the opening on the covering when the connector module slides out of the covering.

According to another aspect of the invention, the first set of metal contacts is exposed out of the covering and the first end of the conductive resilient piece protrudes from the covering for electrically contacting the conductive component when the connector module is located at a fully extended position relative to the covering, and the first set of metal contacts and the conductive resilient piece are contained inside the covering when the connector module is located at a fully retracted position relative to the covering.

According to another aspect of the invention, the first end of the conductive resilient piece is fixed on an outer surface of the housing, a slot is formed on an inner area of the housing, and a second end of the conductive resilient piece is movably disposed inside the slot on the housing.

The retractable connector device of the present invention can move the connector module relative to the covering to stand at the fully extended position for inserting into and electrically contacting the conductive component of the connector receptacle, and can further move the connector module relative to the covering to stand at the fully retracted position for protection of first set of metal contacts and conductive resilient piece. The conductive resilient piece does not electrically contact the second set of metal contacts when the connector module stands at the fully retracted position, so as to prevent the conductive resilient piece from resilient fatigue or damage by physical collision and prevent the retractable connector device from damage by the electrical conduction with other charged component through the conductive resilient piece and the first set of metal contacts. After the retractable connector device is inserted into the connector receptacle, the conductive components of the connector receptacle can electrically contact the first set of metal contacts and the conductive resilient piece and resiliently deform the conductive resilient piece to electrically contact the second set of metal contacts for establishing the data transmission between the retractable connector device and the connector receptacle.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
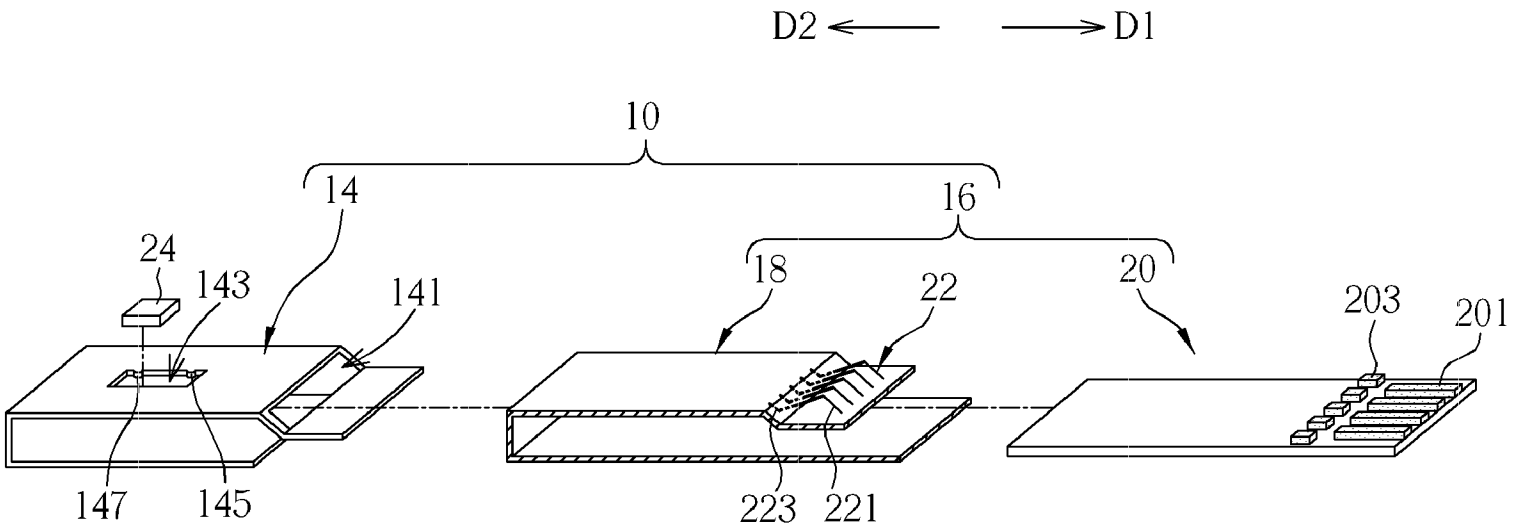
FIG. 1 is an exploded diagram of a retractable connector device according to an embodiment of the present invention.

Please refer to FIG. 1. FIG. 1 is an exploded diagram of a retractable connector device 10 according to an embodiment of the present invention. The retractable connector 10 includes a covering 14 and a connector module 16. The connector module 16 can be slidably disposed inside the covering 14, so that the covering 14 protects the connector module 16.

Figure 2:
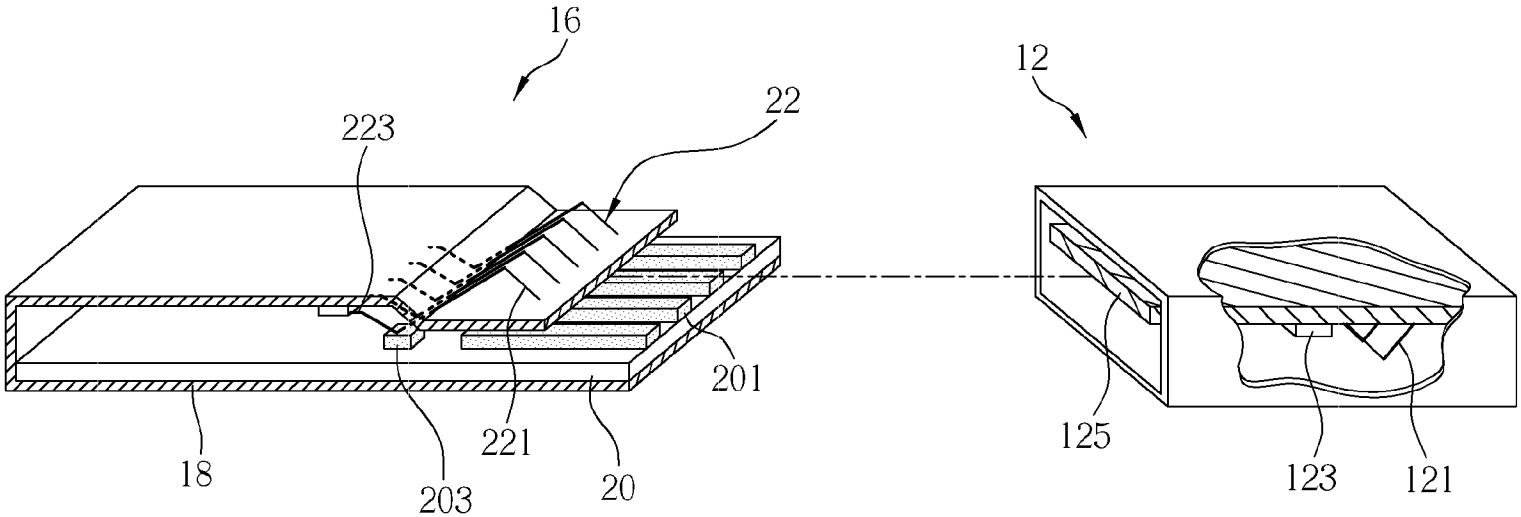
FIG. 2 is a diagram of a connector module and a connector receptacle according to the other embodiment of the present invention.

However, the connector module 16 can be inserted into the connector receptacle 12 without the covering 14. Please refer to FIG. 2. FIG. 2 is a diagram of the connector module 16 and the connector receptacle 12 according to another embodiment of the present invention. The connector module 16 includes a housing 18, a substrate 20 whereon a first set of metal contacts 201 and a second set of metal contacts 203 are formed, and at least one conductive resilient piece 22 piercing through the housing 18.

For example. the connector receptacle 12 includes a first set of conductive components 121, a second set of conductive components 123, and a tongue 125 whereon the first set of conductive components 121 and the second set of conductive components 123 are disposed. The tongue 125 can be made of insulating material. The first set of conductive components 121 is for electrically contacting the first set of metal contacts 201, and the second set of conductive components 123 is for pressing and electrically contacting the conductive resilient piece 22 and conducting the second set of metal contacts 203. As shown in FIG. 2, the first set of metal contacts 201 is disposed adjacent to an edge of the substrate 20 and is exposed outwardly when the substrate 20 is disposed inside the housing 18. A first end 221 of the conductive resilient piece 22 is disposed on the housing 18 immovably. For example, the first end 221 of the conductive resilient piece 22 can be fixed on an outer surface of the housing 18.

As shown in FIG. 2, a bottom of the housing 18 is for holding the substrate 20, so that a bottom length of the housing 18 is preferably equal to a length of the substrate 20 without limitation. Further, the bottom length of the housing 18 is preferably greater than a top length of the housing 18, so that the first set of metal contacts 201 disposed adjacent to the edge of the substrate 20 is exposed outwardly from the housing 18, and the second set of metal contacts 203 disposed on the substrate 20 behind the first set of metal contacts 201 is hidden inside the housing 18. Besides, a front top of the housing 18 can be a ladder-shaped structure for disposing the conductive resilient piece 22. The ladder-shaped structure can be composed of two parallel slabs and a bridging plank, and the bridging plank connects between the two slabs for forming a stage difference on the front top of the housing 18. Generally, the bridging plank can be perpendicular to the slabs. The stage difference of the ladder-shaped structure can further be an inclined plane shown in FIG. 2, which means an angle between the bridging plank and the slabs are different from 90 degrees. When the connector module 16 is inserted into the connector receptacle 12, which means the bottom of the housing 18 and the substrate 20 enter the connector receptacle 12, the ladder-shaped structure of the housing 18 contacts against the tongue 125 for standing the connector module 16 relative to the connector receptacle 12, such that the first set of metal contacts 201 is electrically contacted the first set of conductive components 121 and the conductive resilient piece 22 is electrically contacted and pressed by the second set of conductive components 123. Therefore, the conductive resilient piece 22 is resiliently deformed and electrically contacts the second set of metal contacts 203 to conduct the second set of metal contacts 201 with the second set of conductive components 123, so as to execute data transmission between the connector module 16 and the connector receptacle 12.

In another embodiment of the invention, the first set of metal contacts 201 conforms to USB 2.0 standard, and the first set and the second set of metal contacts 201, 203 collectively conform to USB 3.0 standard, which means when the connector module 16 is inserted into an USB 3.0 receptacle such as the connector receptacle 12, the first set of metal contacts 201 electrically contacts the first set of conductive components 121 and the second set of metal contacts 203 conducts with the second set of conductive components 123 for data transmission between the connector module 16 and the receptacle 12 according to a USB 3.0 standard, however when the connector module 16 is inserted into an USB 2.0 receptacle with only the first set of conductive components 121, which is not shown in the figure, the connector module 16 can transmit data with the USB 2.0 receptacle according to the USB 2.0 standard with the first set of metal contacts 201 electrically contacting the first set of conductive components 121 but without the second set of metal contacts 203 conducting with any conductive components of the USB 2.0 receptacle through the conductive resilient pieces 22 electrically contacting therewith. In this embodiment, the first set of metal contacts 201 includes four metal contacts, and the second set of metal contacts 203 includes five metal contacts. Thus, an amount of the conductive resilient pieces 22 corresponds to an amount of the second set of metal contacts 203, which means the connector module 16 of the present invention includes five conductive resilient pieces 22, and positions of the conductive resilient pieces 22 are set according to arrangement of the second set of metal contacts 203.

Figure 3:
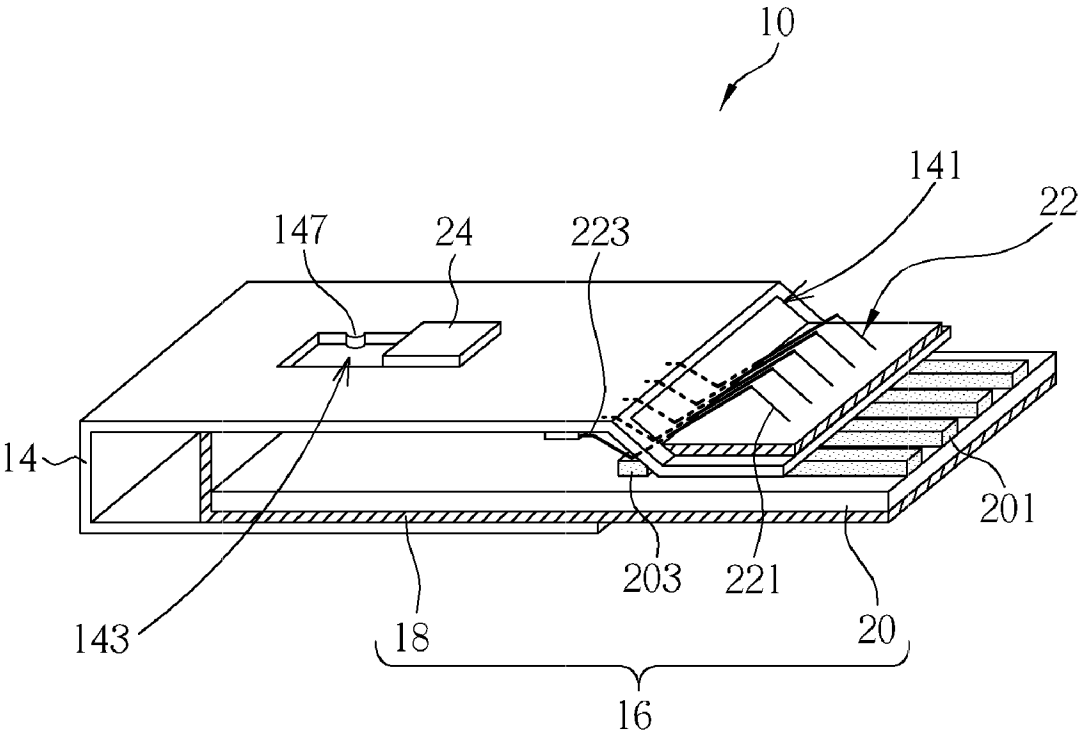
FIG. 3 and FIG. 4 are diagrams of the connector module and a covering in different statuses according to the embodiment of the present invention.
Figure 4:
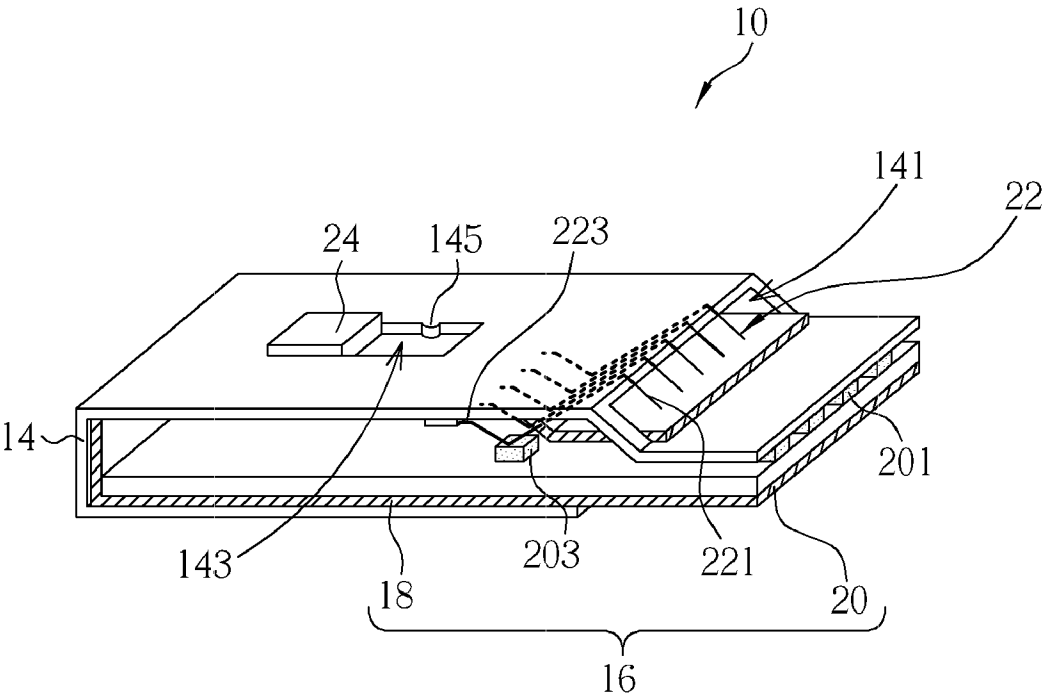
Figure 5:
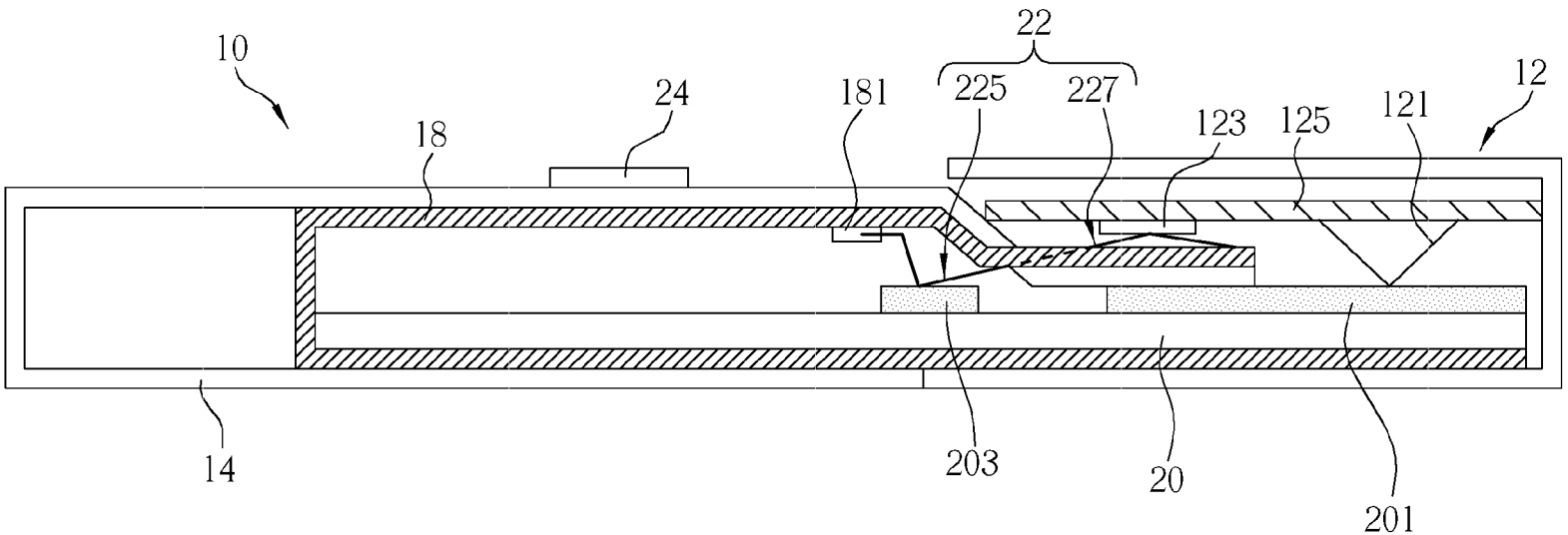
FIG. 5 is a sectional view of the retractable connector device and the connector receptacle according to the embodiment of the present invention.

In order to further protect the resilient pieces 22 and the first set of metal contacts 201 from damage by physical collision and electrical conduction, the connector module 16 may be slidably disposed in a covering 14. Please refer to FIG. 3 to FIG. 5. FIG. 3 and FIG. 4 are diagrams of the connector module 16 and the covering 14 in different statuses according to an embodiment of the present invention. FIG. 5 is a sectional view of the retractable connector device 10 inserting into the connector receptacle 12 according to the embodiment of the present invention. A first opening 141 is formed on the covering 14. As shown in FIG. 3, the front tops of the covering 14 and the housing 18 can be the similar ladder-shaped structures. The first opening 141 is formed on the bridging plank of the covering 14. When the connector module 16 slides out of the covering 14, the resilient piece 22 can protrude from the opening 141 on the covering 14, and the first set of metal contacts 201 can be exposed out of the covering 14. As shown in FIG. 4, when the connector module 16 slides into the covering 14, the conductive resilient piece 22 and the first set of metal contacts 201 can be moved with the connector module 16 to hide into the covering 14.

Furthermore, as shown in FIG. 5, When the connector module 16 slides out of the covering 14 to a fully extended position relative to the covering 14 and is further inserted into the connector receptacle 12, the first set of metal contacts 201 and the conductive resilient piece 22 electrically contact the first set of conductive components 121 and the second set of conductive components 123, respectively, and the conductive resilient piece 22 is resiliently deformed as being pressed by the second set of conductive components 123 for electrically contacting the second set of metal contacts 203. On the other hand, as shown in FIG. 3 to FIG. 5, when the connector module 16 slides into the covering 14 to a fully retracted position, the first set of metal contacts 201, the second set of metal contacts 203, and the conductive resilient piece 22 are contained inside the covering 14, and the second set of metal contacts 203 and the conductive resilient piece 22 do not electrically contact with each other.

In an embodiment of the invention, the conductive resilient piece 22 is for being pressed by the second set of conductive components 123, and the first end 221 of the conductive resilient piece 22 is fixed on the outer surface of the housing 18 for preventing the conductive resilient piece 22 from being displaced and/or damaged by pressure of the second set of conductive components 123 or physical collision of an external object.

In another embodiment of the invention, as shown in FIG. 3 to FIG. 5, a slot 181 can be formed on an inner area of the housing 18, and a second end 223 of the conductive resilient piece 22 can be movably disposed inside the slot 181 on the housing 18. Therefore, the slot 181 provides a space for buffering the conductive resilient piece 22 when the conductive resilient piece 22 is pressed by the second set of conductive component 123.

In another embodiment of the invention, as shown in FIG. 3 to FIG. 5, the conductive resilient piece 22 can be a serpentine piece. The serpentine piece can be composed of a V-shaped section 225 which is adjacent to the second end 223 and a reverse V-shaped section 227 which is adjacent to the first end 221. When the reverse V-shaped section 227 of the conductive resilient piece 22 is electrically contacted and pressed by the second set conductive components 123, the conductive resilient piece 22 is resiliently deformed and the V-shaped section 225 of the conductive resilient piece 22 is able to electrically contact the second set of metal contacts 203 for electrical conduction between the second set of conductive components 123 and the second set of metal contacts 203. However, the shape of the conductive resilient piece 22 is not limited to the above-mentioned embodiment depending on the design requirement or preference, for example, the conductive resilient piece 22 can be composed of two curved sections or a combination of a U-shaped section and a reverse U-shaped section.

In addition, as shown in FIG. 1 and FIG. 3 to FIG. 5, a second opening 143 can be formed on an upper surface or a lateral surface of the covering 14, and the retractable connector device 10 can further include a slide button 24 coupled through the second opening 143 to the connector module 16. The covering 14 can include a first detent 145 and a second detent 147, which are disposed on the second opening 143 or any other place of the covering 14. The slide button 24 can move in a first direction D1 for extending the connector module 16 from the covering 14, and the connector module 16 can be stood at the fully extended position (as shown in FIG. 4) relative to the covering 14 when the slide button 24 is stopped by the first detent 145. On the other way, the slide button 24 can move in a second direction D2, which is opposite to the first direction D1, for retracting the connector module 16 within the covering 14, and the connector module 16 can be stood at the fully retracted position (as shown in FIG. 5) relative to the covering 14 when the slide button 24 is stopped by the second detent 147. Therefore, the connector module 16 can be moved relative to the covering 14 slidably via the slide button 24, so as to switch the connector module 16 between the fully extended position and the fully retracted position. It should be mentioned that the first detent 145 and the second detent 147 can respectively be protrusions or concaves. Structures of the detents are not limited to the above-mentioned embodiment, and depend on actual demand.

For containing the serpentine conductive resilient piece 22, front tops of the housing 18 and the covering 14 can be the ladder-shaped structures, and a height of the conductive resilient piece 22 is lower than height difference of the ladder-shaped structures, so the connector module 16 is not interfered with a casing 125 of the connector receptacle 12 when the retractable connector device 10 is inserted into the connector receptacle 12. Moreover, a bottom length of the covering 14 opposite to the first set of metal contacts 201 and the second set of metal contacts 203 of the substrate 20 is smaller than a top length of the covering 14 facing to the first set of metal contacts and the second set of metal contacts. As shown in FIG. 5, the ladder-shaped structure of the covering 14 contacts against the tongue 125 of the connector receptacle 12 for preventing the retractable connector device 10 from inserting too deeply into the connector receptacle 12 which may cause the first set of metal contacts 201 and the resilient pieces 22 of the retractable connector device 10 unable to electrically contact the first set of conductive components 121 and the second set of conductive components 123 of the connector receptacle 12 precisely.

In conclusion, the connector module 16 and the retractable connector device 10 of the present invention can respectively be a USB 3.0 connector which is also compatible with a USB 2.0 connector receptacle. The retractable connector device 10 can be separated from two parts, such as the covering 14 and the connector module 16. The connector module 16 can be inserted into the connector receptacle 12 for electrically contacting the first set of metal contacts 201 and the conductive resilient pieces 22 to the first set conductive components 121, the second set of conductive components 123 and the second set of metal contacts 203 without the covering 14. Or the connector module 16 can be slidably disposed inside the covering 14, so that a user can push the connector module 16 out of the covering 14 via the slide button 24, so as to insert the connector module 16 into the connector receptacle 12 for electrically contact between the first set of metal contacts 201, the conductive resilient pieces 22, the first set conductive components 121, the second set of conductive components 123 and the second set of metal contacts 203, and can further push the connector module 16 into the covering 14 via the side button 24 for protection and storage.

The connector module 16 includes the first set of metal contacts 201 and the conductive resilient piece 22 that are not electrically contacted with other conductive components when the retractable connector device 10 is not inserted into the connector receptacle 12. Therefore, the connector module 16 and the retractable connector device 10 of the present invention has function of preventing damage by electrical conduction with other charged device due to isolation of the second set of metal contacts 203 and the conductive resilient piece 22. After the retractable connector device 10 is inserted into the connector receptacle 12, the first set of metal contacts 201 can electrically contact the first set of conductive components 121, and the reverse V-shaped section 227 of the conductive resilient piece 22 can be electrically contacted and pressed by the second set of conductive components 123 to move the V-shaped section 225 of the conductive resilient piece 22 to electrically contact the second set of metal contacts 203 (which means the conductive resilient piece 22 is resiliently deformed) for conducting the second set of metal contacts 203 with the second set of conductive components 123, so as to transmit data between the retractable connector device 10 and the connector receptacle 12.

Comparing to the prior art, the retractable connector device of the present invention can move the connector module relative to the covering to stand at the fully extended position for inserting into and electrically contacting the connector receptacle, and can further move the connector module relative to the covering to stand at the fully retracted position for protection. The conductive resilient piece does not electrically contact the second set of metal contacts when the connector module stands at the fully retracted position, so as to prevent the substrate from damage of electrostatic discharge. After the retractable connector device is inserted into the connector receptacle and the connector module stands at the fully extended position, the conductive components of the connector receptacle can electrically contact the first set of metal contacts and the conductive resilient piece, so as to resiliently deform the conductive resilient piece to electrically contact the second set of metal contacts for establish the data transmission between the retractable connector device and the connector receptacle.

Those skilled in the art will readily observe that numerous modifications and alterations of the device and method may be made while retaining the teachings of the invention.

What is claimed is:

1. A connector module, comprising:

a housing;

a substrate whereon a first set and a second set of metal contacts are separately formed, the substrate being disposed inside the housing with the first set of metal contacts exposed outwardly; and at least one conductive resilient piece piercing through the housing, a first end of the conductive resilient piece being fixed on an outer surface of the housing, and the conductive resilient piece being resiliently deformed and electrically contacting the second set of metal contacts when the conductive resilient piece is pressed by a conductive component of an connector receptacle.

2. The connector module of claim 1, wherein a slot is formed on an inner area of the housing, and a second end of the conductive resilient piece is movably disposed inside the slot on the housing.

3. The connector module of claim 1, wherein the conductive resilient piece composed of a V-shaped section and a reverse V-shaped section is a serpentine piece, the V-shaped section of the conductive resilient piece is for contacting the second set of metal contacts, and the reverse V-shaped section of the conductive resilient piece is for being pressed by the conductive component.

4. The connector module of claim 1, wherein the first set of metal contacts conforms to USB 2.0 standard.

5. The connector module of claim 4, wherein the first set and the second set of metal contacts contacted by the resiliently deformed conductive resilient piece when pressed by the conductive component collectively conform to USB 3.0 standard.

6. A retractable connector device, comprising:

a covering; and a connector module slidably disposed inside the covering, the connector module comprising:

a housing;

a substrate whereon a first set and a second set of metal contacts are separately formed, the substrate being disposed inside the housing with the first set of metal contacts exposed outwardly; and at least one conductive resilient piece piercing through the housing, a first end of the conductive resilient piece being disposed on the housing, and the conductive resilient piece being resiliently deformed and electrically contacting the second set of metal contacts when the conductive resilient piece is pressed by a conductive component of an connector receptacle.

7. The retractable connector device of claim 6, wherein a first opening is formed on the covering, and the first set of metal contacts is exposed out of the covering and the first end of the conductive resilient piece protrudes from the opening on the covering when the connector module slides out of the covering.

8. The retractable connector device of claim 6, wherein the first end of the conductive resilient piece is fixed on an outer surface of the housing, a slot is formed on an inner area of the housing, and a second end of the conductive resilient piece is movably disposed inside the slot on the housing.

9. The retractable connector device of claim 6, wherein the conductive resilient piece composed of a V-shaped section and a reverse V-shaped section is a serpentine piece, the V-shaped section of the conductive resilient piece is for contacting the second set of metal contacts, and the reverse V-shaped section of the conductive resilient piece is for being pressed by the conductive component.

10. The retractable connector device of claim 7, further comprising:

a second opening formed on the covering; and a slide button coupled through the second opening to the connector module, the slide button moving in a first direction for extending the connector module from the covering, and the slide button moving in a second direction opposite to the first direction for refracting the connector module within the covering.

11. The retractable connector device of claim 10, wherein the covering comprises a first detent for stopping the slide button to stand the connector module at a fully extended position relative to the covering, and a second detent for stopping the slide button to stand the connector module at a fully refracted position relative to the covering.

12. The retractable connector device of claim 11, wherein the first set of metal contacts is exposed out of the covering and the first end of the conductive resilient piece protrudes from the covering for electrically contacting the conductive component when the connector module is located at a fully extended position relative to the covering, and the first set of metal contacts and the conductive resilient piece are contained inside the covering when the connector module is located at a fully refracted position relative to the covering.

13. The retractable connector device of claim 7, wherein a top of the covering is a ladder-shaped structure.

14. The retractable connector device of claim 13, wherein the ladder-shaped structure of the covering contacts against a tongue of the connector receptacle so that the first set of metal contacts and the conductive resilient piece electrically contact the conductive component.

15. The retractable connector device of claim 6, wherein the first set of metal contacts conforms to USB 2.0 standard.

16. The retractable connector device of claim 6, wherein the first set and the second set of metal contacts contacted by the resiliently deformed conductive resilient piece when pressed by the conductive component collectively conform to USB 3.0 standard.

* * * * *